US007314306B2

(12) United States Patent
Kozyuk

(10) Patent No.: US 7,314,306 B2
(45) **Date of Patent: *Jan. 1, 2008**

(54) HOMOGENIZATION DEVICE AND METHOD OF USING SAME

(75) Inventor: Oleg V. Kozyuk, Westlake, OH (US)

(73) Assignee: Five Star Technologies, Inc., Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/411,565

(22) Filed: Apr. 26, 2006

(65) Prior Publication Data

US 2006/0193199 A1 Aug. 31, 2006

Related U.S. Application Data

(63) Continuation of application No. 10/963,079, filed on Oct. 12, 2004, now abandoned, which is a continuation of application No. 10/271,611, filed on Oct. 15, 2002, now Pat. No. 6,802,639.

(51) Int. Cl.
*B01F 5/08* (2006.01)

(52) U.S. Cl. ..... 366/176.2

(58) Field of Classification Search ..... 366/176.2, 366/176.1; 137/625.38, 625.37; 138/46, 138/45, 44

See application file for complete search history.

(56) References Cited

U.S. PATENT DOCUMENTS 3,776,278 A 12/1973 Allen
4,081,863 A 3/1978 Rees
4,127,332 A 11/1978 Thiruvengadam et al.
4,135,829 A 1/1979 Grillo et al.
4,479,509 A 10/1984 Dear et al.
4,506,991 A 3/1985 Hudson
4,585,357 A 4/1986 Ogata
4,610,548 A 9/1986 Hallet et al.
4,671,321 A 6/1987 Paetzel et al.
5,232,726 A 8/1993 Clark et al.
5,723,518 A 3/1998 Kahl et al.
5,820,259 A * 10/1998 Cummins et al. ..... 366/163.2
6,106,145 A 8/2000 Winslow
6,305,836 B1 * 10/2001 Jarchau ..... 366/176.2
6,341,888 B1 * 1/2002 Ekholm et al. ..... 366/160.1
6,416,214 B2 * 7/2002 Forslund et al. ..... 366/163.2
6,502,979 B1 1/2003 Kozyuk
6,802,639 B2 * 10/2004 Kozyuk ..... 366/176.2
7,086,777 B2 * 8/2006 Kozyuk ..... 366/176.2
7,207,712 B2 * 4/2007 Kozyuk ..... 138/46

* cited by examiner

*Primary Examiner*—Tony G. Soohoo
(74) *Attorney, Agent, or Firm*—Benesch, Friedlander, Coplan & Aronoff LLP

(57) ABSTRACT

A homogenization device comprising a flow-through channel having at least two local constrictions of flow wherein the size of a first local constrictions is adjustable thereby permitting variable flow rate through one portion of the device and the size of a second local constriction is fixed thereby permitting constant flow rate through another portion of the device.

9 Claims, 6 Drawing Sheets

HOMOGENIZATION DEVICE AND METHOD OF USING SAME

CROSS REFERENCE TO RELATED APPLICATION

This application is a continuation of U.S. application Ser. No. 10/963,079 filed on Oct. 12, 2004 now abandoned, which is a continuation of U.S. application Ser. No. 10/271,611 filed on Oct. 15, 2002, which is now U.S. Pat. No. 6,802,639.

BACKGROUND

This application is directed to a homogenization device, and more particularly to a homogenization device having an adjustable orifice, and even more particularly to a homogenization device having an adjustable orifice for homogenization of a multi-component stream, having a liquid component and a substantially insoluble component that may be either a liquid or a finely divided solid.

In accordance with U.S. Pat. No. 4,127,332, there is disclosed a homogenization apparatus which provides an emulsion or colloidal suspension having an extremely long separation half-life by the use of cavitating flow. The prior art homogenization apparatus is constructed of a generally cylindrical conduit including an orifice plate assembly extending transversely thereacross and having an orifice opening provided therein. The orifice opening is described as embodying various designs such as circular blunt or sharp edged, square sharp edged and, a pair of substantially semi-circular annular segments. The homogenization process is effected by passing a multicomponent stream, including a liquid and at least one insoluble component, into a cavitating turbulent velocity shear layer created by the orifice opening through which the stream flows with a high velocity. The cavitating turbulent shear layer provides a flow regime in which vapor bubbles form, expand, contract and ultimately collapse. By subsequently exposing the turbulent shear layer to a sufficient high downstream pressure, the bubbles collapse violently and cause extremely high pressure shocks which cause intermittent intermixing of the multicomponent stream. As a result, a homogenized effluent of liquid and the insoluble component is generated which has a substantially improved separation half-life.

In accordance with the prior art homogenization apparatus, it is generally known that the effective intermixing of the multicomponent stream is dependent upon a number of factors, for example, upstream pressure, downstream pressure, conduit diameter, orifice diameter, etc. The most critical factor effecting the homogenizing quality and efficiency is generally considered to be the orifice diameter. U.S. Pat. Nos. 4,506,991 and 4,081,863 disclose emulsifier and homogenization devices having adjustable orifices to permit the operator to change and control the overall homogenizing quality and efficiency.

BRIEF DESCRIPTION OF THE DRAWINGS

In the accompanying drawings, embodiments of a tire, label, and method are illustrated that, together with the detailed description given below, describe example embodiments of the claimed invention. It will be appreciated that the illustrated boundaries of elements in the figures represent one example of the boundaries. One of ordinary skill in the art will appreciate that one element may be designed as multiple elements or that multiple elements may be designed as a single element. An element shown as an internal component of another element may be implemented as an external component and vice-versa.

Further, in the accompanying drawings and description that follow, like parts are indicated throughout the drawings and description with the same reference numerals, respectively. The figures are not drawn to scale and the proportions of certain parts have been exaggerated for convenience of illustration.

DETAILED DESCRIPTION

Figure 1:
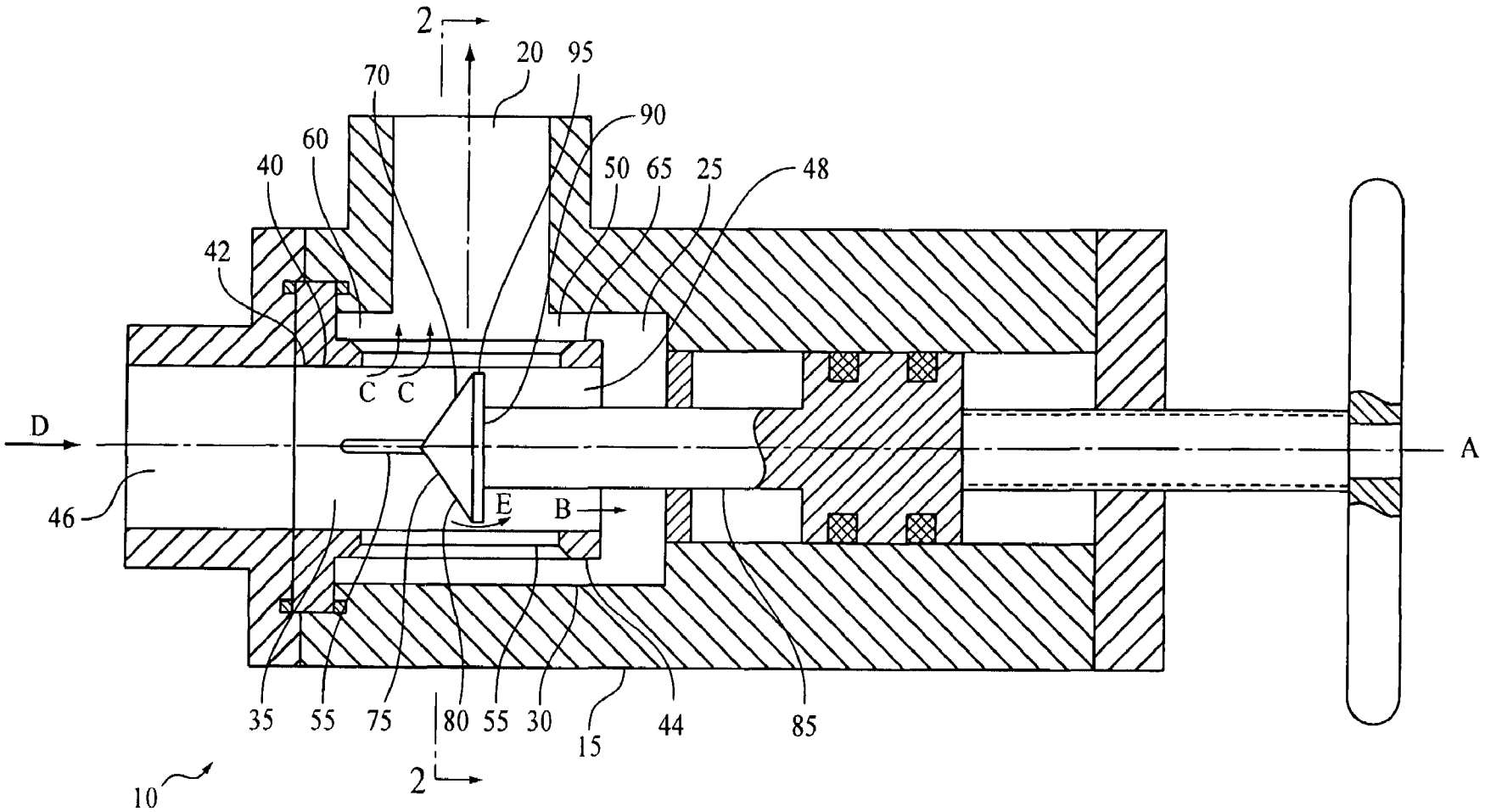
FIG. 1 is a cross-sectional view taken along a longitudinal section of one embodiment of a homogenization device 10.

Illustrated in FIG. 1 is one embodiment of homogenization device 10. The homogenization device 10 comprises a housing 15 having an outlet opening 20 for exiting fluid and dispersants from device 10 and an internal cylindrical chamber 25 (hereinafter referred to as "internal chamber 25") defined by an inner cylindrical surface 30. Internal cylindrical chamber 25 has a longitudinal axis A and is in fluid communication with outlet opening 20. Although it is preferred that the cross-section of internal chamber 25 is circular, the cross-section of internal chamber 25 may take the form of any geometric shape such as square, rectangular, or hexagonal and still be within the scope of the present invention.

Device 10 further comprises a flow-through channel 35 defined by a cylindrical wall 40 having an inner surface 42, an outer surface 44, an inlet opening 46 for introducing fluid into device 10, and an outlet opening 48. Although it is preferred that the cross-section of flow-through channel 35 is circular, the cross-section of flow-through channel 35 may take the form of any geometric shape such as square, rectangular, or hexagonal. Flow-through channel 35 is coaxially disposed within internal chamber 25 thereby forming an annular space 50 between inner surface 42 of internal chamber 25 and outer surface 44 of flow-through channel 35. Outlet opening 60 in flow-through channel 35 permits fluid communication between flow-through channel 35 and internal chamber 25 as indicated by arrow B. Cylindrical wall 40 includes a plurality of orifices, each taking the shape of a longitudinal slot 55, provided therein to permit fluid communication between flow-through channel 35 and internal chamber 25 as indicated by arrows C.

Figure 3:
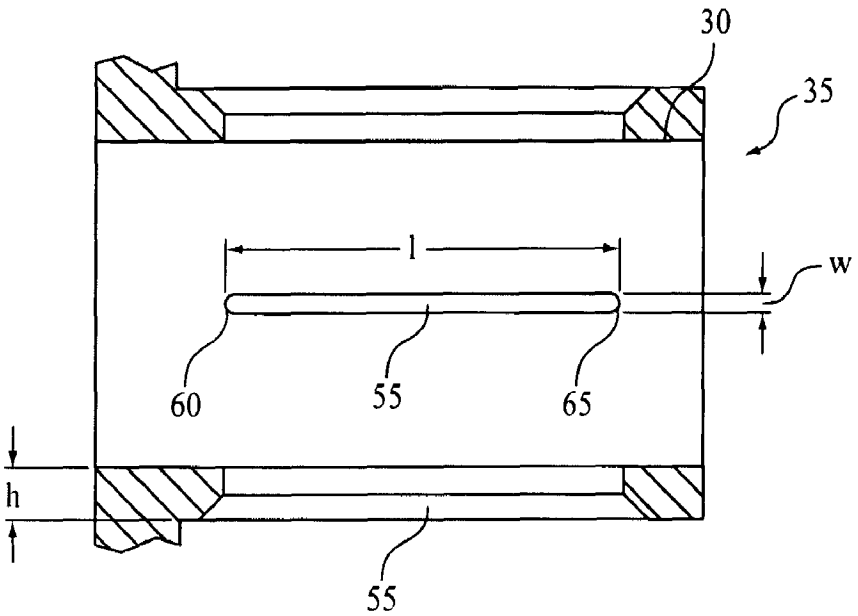
FIG. 3 is a cross-sectional view of flow-through channel 35 defined by cylindrical wall 40 having longitudinal slots 55 provided therein.
Figure 2:
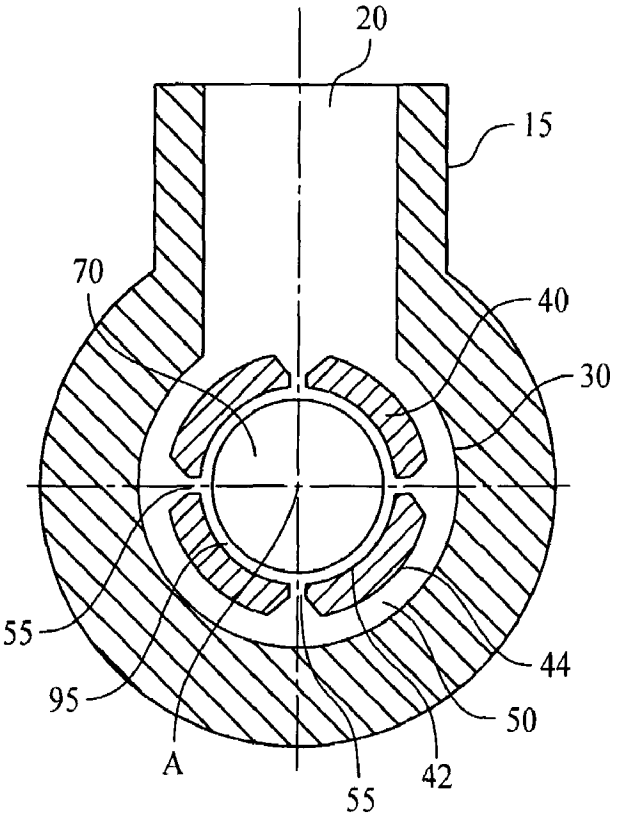
FIG. 2 is a cross-sectional view taken along section A-A of device 10 illustrated in FIG. 1.

Each longitudinal slot 55 has an upstream end 60 and a downstream end 65 defining a length (l) therebetween that is parallel to the direction of fluid flow, a width (w), and a height (h) as shown in FIG. 3. Although FIGS. 1 and 2 illustrate four longitudinal slots 55 provided in cylindrical wall 40, it will be appreciated that any number of slots less than or greater than four may be suitable for the present invention. Further, it will be appreciated that the longitudinal slots may take the form of other shapes (e.g., elliptical, rectangular, square, or any other geometric shape) or a series of orifices that are circular, elliptical, rectangular, square, or any other shape.

Each of the three dimensions of longitudinal slot 55, either alone or in combination with each other, can impact a particular function of device 10. The width of longitudinal slot 55, indicated by dimensional arrows "w" as shown in FIG. 3, can determine the homogenizing quality and efficiency of device 10. The height of longitudinal slot 55, indicated by dimensional arrows "h" as shown in FIG. 3, can determine the product travel distance and, thus, can define the time interval during which energy is released. The length of longitudinal slot 55, indicated by dimensional arrows "l" as shown in FIG. 3, can determine the flow rate of fluid through slot 55. Therefore, by adjusting the length of longitudinal slot 55, the flow rate of device 10 may be changed. Accordingly, to adjust the flow rate of device 10 while maintaining the homogenizing quality and efficiency of device 10, the length (l) of slot 55 needs to be adjustable, while the width (w) of slot 55 needs to be maintained.

To accomplish the tasks of adjusting the length (l) of slot each 55 and maintaining the width (w) of each slot 55, device 10 includes a baffle element 70 coaxially disposed within flow-through channel 35 and movable axially within flow-through channel 35 between upstream end 60 and downstream end 65 of slot 55. Preferably, baffle element 70 includes a conically-shaped surface 75 wherein the tapered portion 80 of conically-shaped surface 75 confronts the fluid flow and a rod 85 is secured to a base portion 90 of baffle element 70. Rod 85 is slidably mounted to housing 15 and is capable of being locked in a position by any locking means known in the art such as a threaded nut or collar (not shown). Rod 85 is connected to a mechanism (not shown) for axial movement of rod 85 relative to housing 15. Such mechanism may be powered by a pneumatic, electric, mechanical, electromechanical, or electromagnetic power source.

Figure 4A:
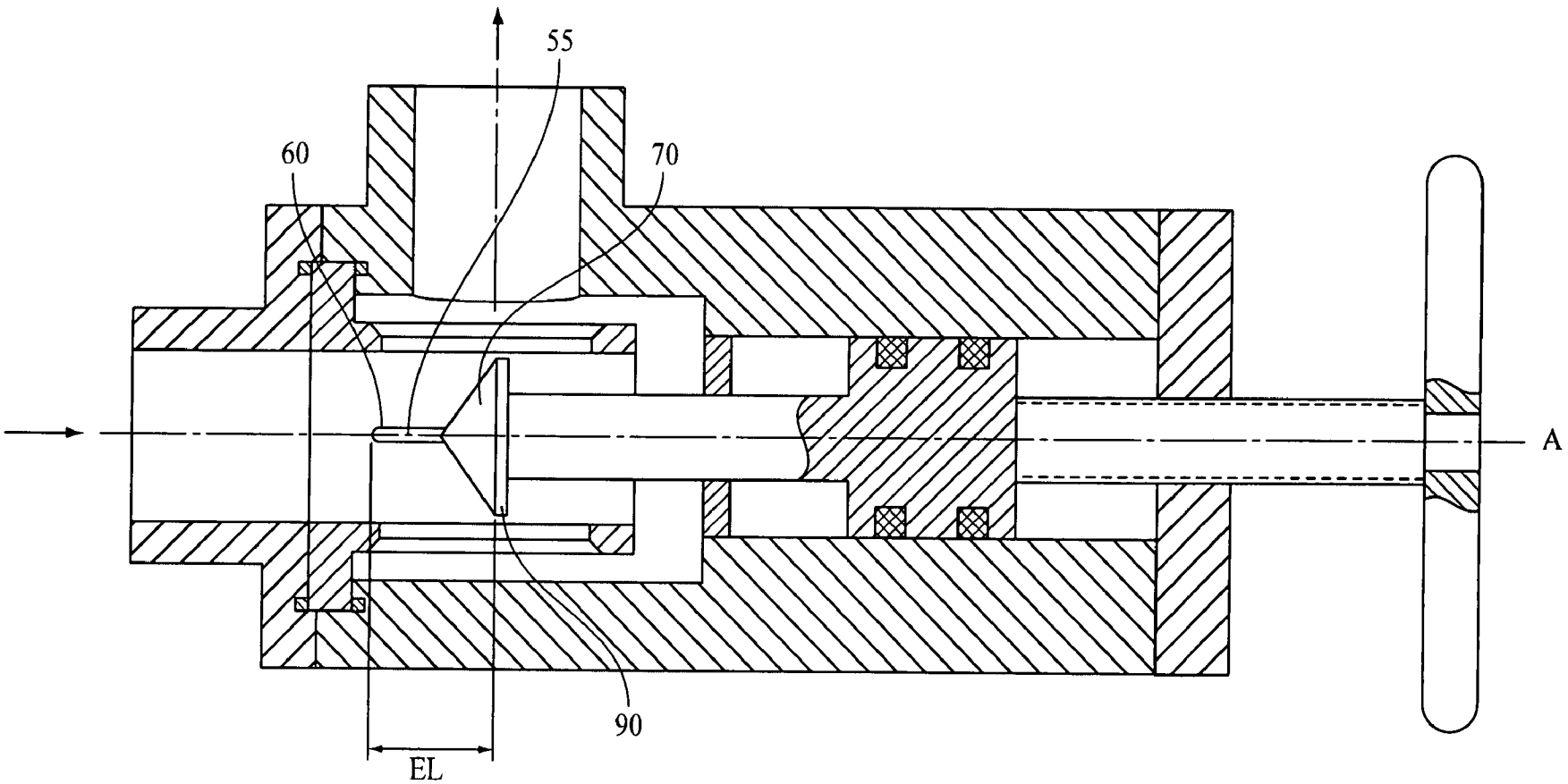
FIG. 4A illustrates the effective length (EL) of the homogenization device 10 in one position.

Baffle element 70 directs a portion of fluid through the effective length of each slot 55. The term "effective length" used herein refers to the axial distance between upstream end 60 of each longitudinal slot 55 and the base portion 90 of baffle element 70 as indicated by the dimensional arrows "EL" shown in FIG. 4A. Since baffle element 70 is movable within flow-through channel 35 between upstream end 60 and downstream end 65 of each slot 55, the effective length of each slot 55 may be changed thereby adjusting the flow rate of fluid through each slot 55. Therefore, the flow rate of fluid through each longitudinal slot 55 is adjustable depending on the axial position of baffle element 70. Although the effective length of longitudinal slot 55 is adjustable by axially moving baffle element 70, the width (w) of slot 75 stays the same. Therefore, the homogenizing quality and efficiency of device 10 stays the same and is not affected by the change in flow rate through each slot 55. Further, the passing of a portion of fluid through each slot 55 may generate a hydrodynamic cavitation field downstream from each slot 55 which further assists in the homogenization process.

Baffle element 70 is also capable of homogenizing fluid and generating a hydrodynamic cavitation field downstream from baffle element 70 via annular orifice 95. Annular orifice 95 is defined as the distance between inner surface 42 of flow-through channel 35 and the perimeter of the base portion 90 of baffle element 70. However, since annular orifice 95 maintains the same distance between inner surface 42 of flow-through channel 35 and the perimeter of the base portion 90 of baffle element 70 regardless of where baffle element 70 is moved within flow-through channel 35, the flow rate of fluid through annular orifice 95 is constant. Although annular orifice 95 is ring-shaped because of the circular cross-section of baffle element 70 and the circular cross-section of cylindrical wall 40, it will be appreciated that if the cross-section of flow-through channel 35 can be any other geometric shape other than circular, then the orifice defined between the wall forming flow-through channel 35 and baffle element 70 may not be annular in shape. Likewise, if baffle element 70 does not have a circular cross-section, then the orifice defined between the wall forming flow-through channel 35 and baffle element 70 may not be annular in shape.

Figure 4B:
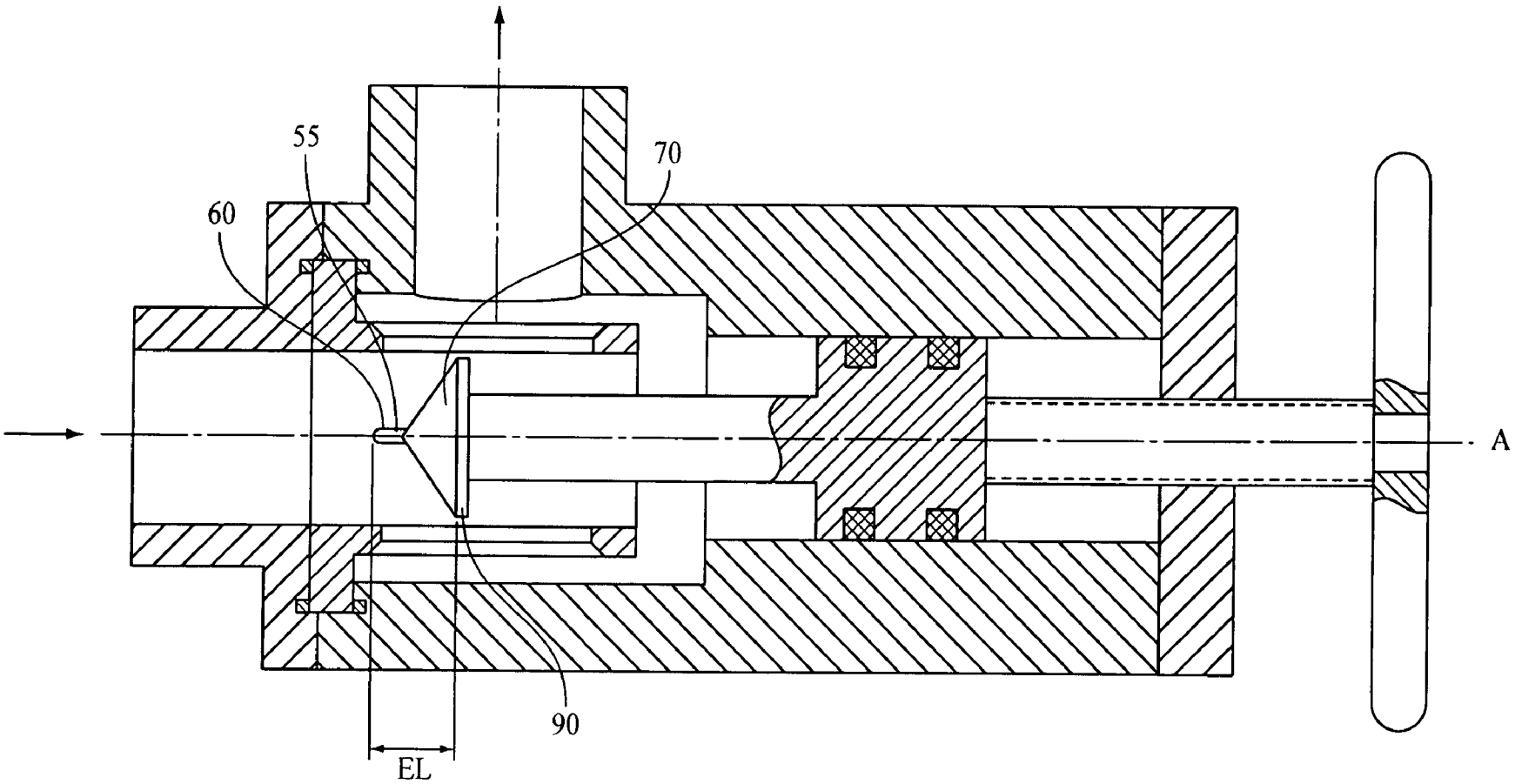
FIG. 4B illustrates the effective length (EL) of the homogenization device 10 in a second position after baffle element 70 is moved axially upstream to decrease the flow rate through the device 10.

To decrease the flow rate of fluid through each slot 55 and ultimately device 10, baffle element 70 is moved axially upstream thereby decreasing the effective length of longitudinal slot 55 as indicated by the dimensional arrows "EL" shown in FIG. 4B. In one example, if the effective length of each slot 55 is equal to 0, then fluid is prevented from passing through each slot 55 and all of the fluid passes through annular orifice 95 at a minimum flow rate. In this example, the flow rate through device 10 is at its minimum level because of the absence of fluid flow through slots 55.

Figure 4C:
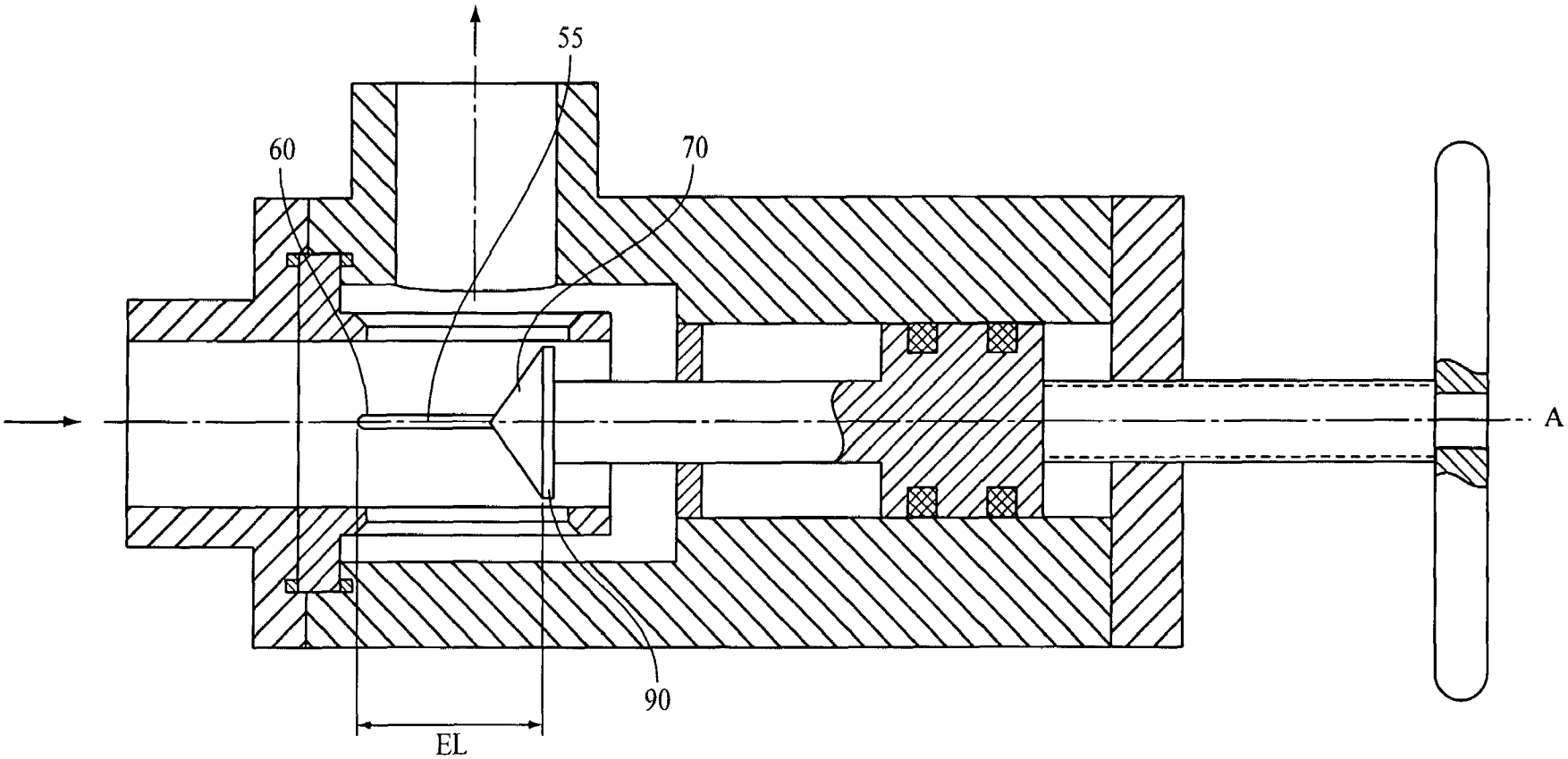
FIG. 4C illustrates the effective length (EL) of the homogenization device 10 in a third position after baffle element 70 is moved axially downstream to increase the flow rate through the device 10.

To increase the flow rate of fluid through each slot 55 and ultimately device 10, baffle element 70 is moved axially downstream thereby increasing the effective length of longitudinal slot 55 as indicated by the dimensional arrows "EL" shown in FIG. 4C. In another example, if the effective length of each slot 55 is equal to the length (l) of each slot 55, then a portion of fluid passes through each slot 55 and the remaining portion of fluid passes through annular orifice 95. In this example, the flow rate through device 10 is at its maximum level because the fluid is permitted to flow through the entire length (l) of each slot 55 and through annular orifice 95.

To further promote the creation and control of cavitation fields downstream from baffle element 70, baffle element 70 is constructed to be removable and replaceable by any baffle element having a variety of shapes and configurations to generate varied hydrodynamic cavitation fields. The shape and configuration of baffle element 70 can significantly effect the character of the cavitation flow and, correspondingly, the quality of dispersing. Although there are an infinite variety of shapes and configurations that can be utilized, several acceptable baffle element shapes and configurations are disclosed in U.S. Pat. No. 5,969,207, which is hereby incorporated by reference in its entirety herein.

It will be appreciated that baffle element 70 can be removably mounted to rod 85 in any acceptable fashion. However, it is preferred that the baffle element threadedly engages rod 85. Therefore, in order to change the shape and configuration of baffle element 70, rod 85 must be removed from device 10 and the original baffle element unscrewed from rod 85 and replaced by a different baffle element which is threadedly engaged to rod 85 and replaced within device 10.

In the operation of device 10, a multi-component stream, having a liquid component and an insoluble component, is introduced into inlet opening 46 of device 10 at a relatively low velocity, but at a relatively high pressure generated by a pump (not shown) upstream from device 10. The multi-component stream moves along arrow D through the inlet opening 46 and enters flow-through channel 35 where the multi-component stream encounters baffle element 70. A portion of the multi-component stream is directed by baffle element 70 through the effective length of each longitudinal slot 55 creating a local constriction of flow. The local constriction forces the portion of the multi-component stream into internal chamber 25 at a high velocity as indicated by arrows C in FIG. 1.

As the multi-component stream is forced through the local constriction defined by the effective length (EL), width (w), and height (h) of each slot 55, the multi-component stream is homogenized into a homogenized liquid caused by the energy release in the passageway and the hydrodynamic cavitation field created downstream from each slot 55. The homogenizing quality and efficiency of the homogenized liquid depends on the width (w) of each slot 55, while the flow rate of the multi-component stream through device 10 depends on the effective length (EL) of each slot 55. The homogenized liquid exits device 10 via outlet opening 20.

Due to the surface area controlled by baffle element 70 within flow-through channel 35, the remaining portion of the multi-component stream is forced to pass between annular orifice 95 creating another local constriction, indicated by arrow E in FIG. 1, created between the outer diameter of the base portion 90 of baffle element 70 and inner surface 42 of flow-through channel 35. By constricting the multi-component stream flow in this manner, the hydrostatic fluid pressure is increased upstream from annular orifice 95. As the remaining portion of the high pressure multi-component stream flows through annular orifice 95 and past baffle element 70, the remaining portion of the multi-component stream is homogenized caused by energy release as the remaining portion of the multi-component stream passes through annular orifice 95. Further, a low pressure cavity is formed downstream from baffle element 70 which promotes the formation of cavitation bubbles. As the cavitation bubbles enter the increased pressure zone upstream past baffle element 70, a coordinated collapsing of the cavitation bubbles occurs in a cavitation field, accompanied by high local pressure and temperature, as well as by other physiochemical effects which initiate the progress of mixing, emulsification, homogenization, or dispersion. The resulting cavitation field, having a vortex structure, makes it possible for processing the liquid and insoluble components of the multi-component stream in flow-through channel 35 downstream from baffle element 70. The processed multi-component stream exits flow-through channel 35 via outlet opening 48, enters internal chamber 25, and exits device 10 via outlet opening 20.

If decreasing the flow rate of the multi-component stream through device 10 is desired, baffle element 70 can be moved axially upstream to decrease the effective length of each slot 55. Rod 85 can be locked in place and the multi-component stream can then be introduced into inlet opening 46 to begin the homogenization process described above. If increasing the flow rate of the multi-component stream through device 10 is desired, baffle element 70 can be moved axially downstream to decrease the effective length of each slot 55. Rod 85 can be locked in place and the multi-component stream can then be introduced into inlet opening 46 to begin the homogenization process described above. Once again, although the flow rate may be increased or decreased due to the adjustment of the effective length (EL) of each slot 55, the homogenizing quality and efficiency stays the same because the width (w) of each slot 55 is maintained.

Figure 5:
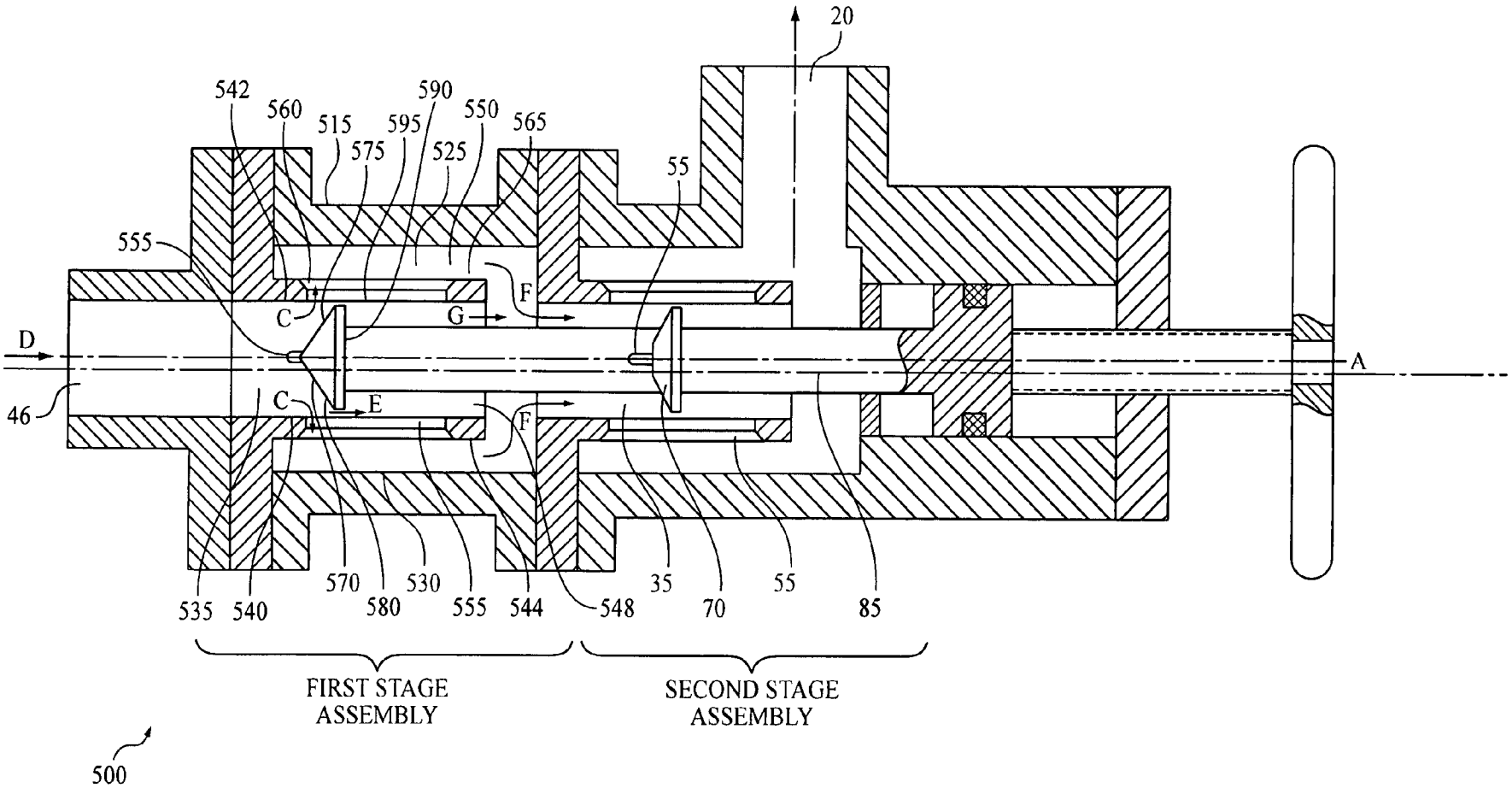
FIG. 5 is a cross-sectional view taken along a longitudinal section of an alternative embodiment of a homogenization device 500.

Illustrated in FIG. 5 is an alternative embodiment of a homogenization device 500 that has two stages as opposed to the single stage homogenization device 10 described above and shown in FIGS. 1 and 2. Homogenization device 500 essentially includes two homogenization devices 10 arranged in series, while sharing the same rod 85 and having a single inlet opening 46 and outlet opening 20. Although device 500 includes a single rod 85 controlling the axial movement of the baffle elements, it will be appreciated that a second rod may be provided to permit independent movement of each baffle element. Accordingly, homogenization device 500 comprises a second housing 515 having an internal cylindrical chamber 525 (hereinafter referred to as "internal chamber 525") defined by an inner cylindrical surface 530. Internal cylindrical chamber 525 shares longitudinal axis A and is in fluid communication with inlet opening 42 of the second stage assembly. Although it is preferred that internal chamber 525 is cylindrical shaped, internal chamber 525 may take the form of any shape such as square, rectangular, or hexagonal. Further, although homogenization device 500 includes two stages, it will be appreciated that more than two stages may be provided.

Device 500 further comprises a second flow-through channel 535 defined by a cylindrical wall 540 having an inner surface 542, an outer surface 544, an inlet opening 546 for introducing fluid into device 500, and an outlet opening 548. Although it is preferred that flow-through channel 535 is cylindrically shaped, flow-through channel 535 may take the form of any shape such as square, rectangular, or hexagonal. Flow-through channel 535 is coaxially disposed within internal chamber 525 thereby forming an annular space 550 between inner surface 542 of internal chamber 525 and outer surface 544 of flow-through channel 535. Outlet opening 560 in flow-through channel 535 permits fluid communication between flow-through channel 535 and internal chamber 525 as indicated by arrow B. Cylindrical wall 540 includes a plurality of orifices, each taking the shape of a longitudinal slot 555, provided therein to permit fluid communication between flow-through channel 535 and internal chamber 525 as indicated by arrows C. Each longitudinal slot 555 has an upstream end 560 and a downstream end 565 defining a length (l) therebetween that is parallel to the direction of fluid flow, a width (w), and a height (h) as shown in FIG. 3. Although FIG. 5 illustrates four longitudinal slots 55 provided in cylindrical wall 40, it is apparent that any number of slots less than or greater than four may be suitable. Further, it will be appreciated that the longitudinal slots may take the form of other shapes (e.g., elliptical, rectangular, square, or any other geometric shape) or a series of orifices that are circular, elliptical, rectangular, square, or any other shape.

Device 500 includes a second baffle element 570 coaxially disposed within flow-through channel 535 and movable axially within flow-through channel 535 between upstream end 560 and downstream end 565 of slot 555. Preferably, baffle element 570 includes a conically-shaped surface 575 wherein the tapered portion 580 of conically-shaped surface 575 confronts the fluid flow and rod 85 is secured to a base portion 590 of baffle element 570. Baffle element 570 directs a portion of fluid through the effective length of each slot 555. Therefore, baffle element 570 is movable within flow-through channel 535 between upstream end 560 and downstream end 565 of each slot 555 to adjust the effective length of each longitudinal slot 555 thereby effecting the flow rate of fluid through each slot 555. Although the effective length of longitudinal slot 55 is adjustable by axially moving baffle element 70, the width (w) of slot 75 stays the same. Accordingly, the homogenizing quality and efficiency of device 10 stays the same and is not affected by the change in flow rate through each slot 555. Further, the passing of a portion of fluid through each slot 555 generates a hydrodynamic cavitation field downstream from each slot 555 which further assists in the homogenization process.

Baffle element 570 is also capable of homogenizing fluid and generating a hydrodynamic cavitation field downstream from baffle element 570 via annular orifice 595 defined as the distance between inner surface 542 of flow-through channel 535 and the perimeter of the base portion 590 of baffle element 570. However, since annular orifice 595 maintains the same distance between inner surface 542 of flow-through channel 535 and the perimeter of the base portion 590 of baffle element 570 regardless of where baffle element 70 is positioned within flow-through channel 535, the flow rate of fluid through annular orifice 595 is constant.

In the operation of device 500, a multi-component stream, having a liquid component and an insoluble component, is introduced into inlet opening 546 of device 500 at a relatively low velocity, but at a relatively high pressure generated by a pump (not shown) upstream from device 500. The multi-component stream moves along arrow D through the inlet opening 546 and enters flow-through channel 535 where the multi-component stream encounters baffle element 570. A portion of the multi-component stream is directed by baffle element 570 through the effective length of each longitudinal slot 555 creating a local constriction of flow. The local constriction forces the portion of the multi-component stream into internal chamber 525 at a high velocity as indicated by arrows C in FIG. 5.

As the multi-component stream is forced through the passageway defined by the effective length (EL), width (w), and height (h) of each slot 555, the multi-component stream is homogenized into a homogenized liquid caused by the energy release in the passageway and the hydrodynamic cavitation field created downstream from each slot 555. The homogenizing quality and efficiency of the homogenized liquid depends on the width (w) of each slot 555, while the flow rate of the multi-component stream through device 500 depends on the effective length (EL) of each slot 555. The homogenized liquid exits the first stage assembly of device 500 via internal chamber 525 and enters the flow-through channel 35 of the second stage assembly of device 500 as indicated by arrows F. The operation through the second stage assembly of device 500 is the same as described above.

Due to the surface area controlled by baffle element 570 within flow-through channel 535, the remaining portion of the multi-component stream is forced to pass between annular orifice 595 creating another local constriction, indicated by arrow E in FIG. 5, created between the outer diameter of the base portion 590 of baffle element 570 and inner surface 42 of flow-through channel 535. By constricting the multi-component stream flow in this manner, the hydrostatic fluid pressure is increased upstream from annular orifice 595. As the high pressure multi-component stream flows through annular orifice 595 and past baffle element 570, the remaining portion of the multi-component stream is homogenized caused by energy release as the remaining portion of the multi-component stream passes through annular orifice 595. Further, a low pressure cavity is formed downstream from baffle element 570 which promotes the formation of cavitation bubbles. As the cavitation bubbles enter the increased pressure zone upstream past baffle element 570, a coordinated collapsing of the cavitation bubbles occurs in a cavitation field, accompanied by high local pressure and temperature, as well as by other physio-chemical effects which initiate the progress of mixing, emulsification, homogenization, or dispersion. The resulting cavitation field, having a vortex structure, makes it possible for processing the liquid and insoluble components of the multi-component stream in flow-through channel 535 downstream from baffle element 570. The processed multi-component stream exits flow-through channel 535 via outlet opening 548, enters and exits internal chamber 525, and enters flow-through channel 535 of the second stage assembly of device 500 as indicated by arrow G. The operation through the second stage assembly of device 500 is the same as described above.

If decreasing the flow rate of the multi-component stream through device 500 is desired, baffle elements 70, 570 can be moved axially upstream to decrease the effective length of each slot 55, 555. Rod 85 can be located in place and the multi-component stream can then be introduced into inlet opening 546 to begin the homogenization process described above. If increasing the flow rate of the multi-component stream through device 500 is desired, baffle elements 70, 570 can be moved axially downstream to decrease the effective length of slot 55, 555. Rod 85 can be locked in place and the multi-component stream can then be introduced into inlet opening 546 to begin the homogenization process described above. Once again, although the flow rate may be increased or decreased due to the adjustment of the effective length of each slot 55, 555, the homogenizing quality and efficiency stays the same because the width (w) of each slot 55, 555 is maintained.

Regarding all embodiments described above, one skilled in the art would appreciate and recognize that the housing may be of unitary construction or may be constructed from a multiple number of parts to form such housing. Further, the inlet opening 46 and outlet opening 20 may or may not be directly provided in the housing.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application illustrates various embodiments, and while these embodiments have been described in some detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

Having thus defined the invention, I claim:

1. A device for homogenizing a fluid, the device comprising:

a flow-through channel defined by at least one wall and having a longitudinal axis, the at least one wall having a series of axially spaced-apart orifices disposed therein; and a baffle element disposed within the flow-through channel defining an orifice between the perimeter of the baffle element and the at least one wall, the baffle element configured to be selectively movable within the flow-through channel to direct at least a portion of the fluid through one or more of the series of orifices, while the remaining portion of the fluid passes through the orifice.

2. The device of claim 1, wherein one or more of the series of orifices is circular shaped.

3. The device of claim 1, wherein one or more of the series of orifices is elliptical shaped.

4. The device of claim 1, wherein one or more of the series of orifices is rectangular shaped.

5. The device of claim 1, wherein one or more of the series of orifices is square shaped.

6. The device of claim 1, wherein the at least one wall is a cylindrical wall.

7. The device of claim 6, wherein the baffle element includes a cylindrical surface and a conically-shaped surface wherein the tapered portion of the conically-shaped surface confronts the fluid flow.

8. The device of claim 7, wherein the orifice is an annular orifice defined between the cylindrical wall of the flow-through channel and the perimeter of the cylindrical surface of the baffle element.

9. The device of claim 1, wherein the orifice creates a local constriction of flow that is capable of generating a hydrodynamic cavitation field downstream from the orifice.

* * * * *